United States Patent [19]

Sze et al.

[11] 4,040,957

[45] Aug. 9, 1977

[54] SEPARATION OF INSOLUBLE MATERIAL FROM COAL LIQUEFACTION PRODUCT BY USE OF A DILUENT

[75] Inventors: Morgan C. Sze, Upper Montclair; George J. Snell, Fords, all of N.J.

[73] Assignee: The Lummus Company, Bloomfield, N.J.

[21] Appl. No.: 659,725

[22] Filed: Feb. 20, 1976

[51] Int. Cl.[2] ..... C10G 1/00

[52] U.S. Cl. ..... 210/73 R; 208/8; 208/10

[58] Field of Search ..... 210/73 R, 83, 202, 53, 210/21; 208/8, 10, 11 LE

[56] References Cited

U.S. PATENT DOCUMENTS

| | | | |
|---|---|---|---|
| 2,221,410 | 11/1940 | Pier | 208/8 |
| 3,120,474 | 2/1964 | Gorin et al. | 208/8 |
| 3,162,594 | 12/1964 | Gorin | 208/8 |
| 3,519,553 | 7/1970 | Johanson et al. | 208/10 |
| 3,678,837 | 8/1972 | Flocco | 208/8 |
| 3,791,956 | 2/1974 | Gorin et al. | 208/8 |
| 3,856,675 | 12/1974 | Sze et al. | 208/8 |
| 3,867,275 | 2/1975 | Gleim et al. | 208/8 |
| 3,884,794 | 5/1975 | Bull et al. | 208/8 |
| 3,954,595 | 5/1976 | Sze | 208/8 |
| 3,974,073 | 8/1976 | Sze et al. | 210/73 R |

FOREIGN PATENT DOCUMENTS

| | | | |
|---|---|---|---|
| 973,826 | 9/1975 | Canada | 208/8 |

*Primary Examiner*—Thomas G. Wyse
*Assistant Examiner*—Ernest G. Therkorn
*Attorney, Agent, or Firm*—Marn & Jangarathis

[57] ABSTRACT

Insoluble materials are separated from a coal liquefaction product having a quinoline insoluble content of greater than 15 wt. % by diluting the product with a diluent which is a solvent for the components which are quinoline soluble and benzene insoluble, with the diluent being added in an amount to provide a mixture having a quinoline insoluble content of no greater than 13 wt. %. Insoluble material is then separated by gravity settling in the presence of a promoter liquid having a 5 volume percent distillation temperature of at least 250° F and a 95 volume percent distillation temperature of at least 350° F and no greater than 750° F, with the promoter liquid having a characterization factor of at least 9.75.

6 Claims, 1 Drawing Figure

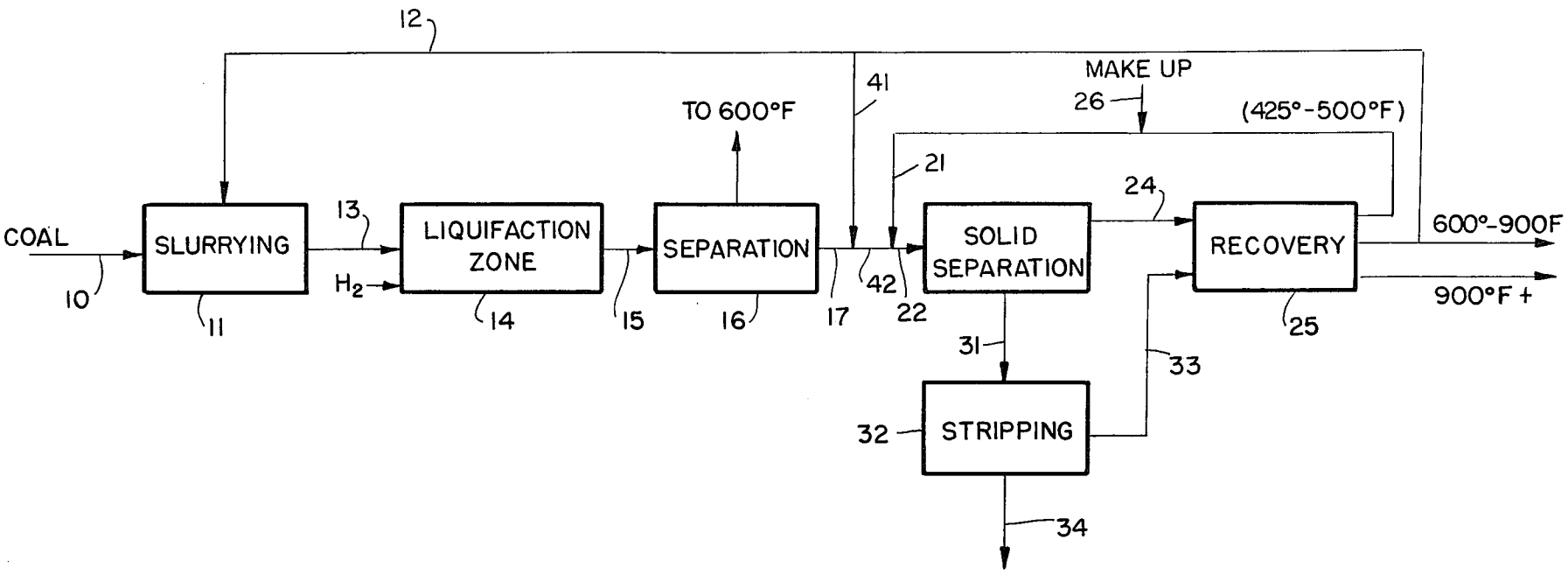
COAL
10
SLURRYING
11
12
13
$H_2$
LIQUIFACTION ZONE
14
15
SEPARATION
16
TO 600°F
17
41
42
21
22
SOLID SEPARATION
24
MAKE UP
26
(425°-500°F)
RECOVERY
25
600°-900°F
900°F +
33
31
STRIPPING
32
34

SEPARATION OF INSOLUBLE MATERIAL FROM COAL LIQUEFACTION PRODUCT BY USE OF A DILUENT

This invention relates to the liquefaction of coal, and more particularly, to the separation of insoluble material from a coal liquefaction product.

Coal can be converted to valuable products by subjecting coal to solvent extraction, with or without hydrogen, to produce a mixture of coal extract and undissolved coal residue, including undissolved extractable carbonaceous matter, fusain and mineral matter or ash.

In U.S. Pat. No. 3,856,675, there is disclosed an improved process for separating insoluble material from a coal liquefaction product wherein such insoluble material is separated by gravity settling in the presence of a promoter liquid having specific characteristics.

The present invention is directed to improvements in the recovery of a net coal product essentially free of insoluble material by a gravity settling technique in the presence of a promotor liquid. More particularly, the present invention is directed to improved recovery of a net coal product essentially free of insoluble material from a coal liquefaction product comprised of insoluble material and carbonaceous matter dissolved in a coal liquefaction solvent wherein the coal liquefaction product has a quinoline insoluble content of at least 15 wt%.

In accordance with the present invention, there is provided a process for separating insoluble material from a coal liquefaction product comprised of insoluble material and carbonaceous matter dissolved in a coal liquefaction solvent and having a quinoline insoluble content of at least 15 wt% wherein the coal liquefaction product is diluted with a liquid diluent which is a solvent for the components which are quinoline soluble and benzene insoluble, with the diluent being added in an amount to provide a mixture of coal liquefaction product and diluent having a quinoline insoluble content of no greater than 13 wt%. The diluted coal liquefaction product is then admixed with a promoter liquid to enhance and promote the separation of insoluble material, followed by recovery of an essentially solid free coal product by a gravity settling technique. It has been found that by treating a coal liquefaction product having a quinoline insoluble content of at least 15 wt% with a diluent, as hereinabove described, prior to effecting gravity settling in the presence of a promoter liquid, there can be obtained improved recovery of the 800° F+ fraction (heavier fraction) as an ash free product.

The diluent, which is employed for diluting the coal liquefaction product, prior to admixture with the promoter liquid and separation of insoluble material, is a diluent which is known to be a solvent for the quinoline soluble and benzene insoluble components in the coal liquefaction product. Such liquid solvents are known in the art, and such solvents are exemplified by: substituted and unsubstituted, polynuclear aromatic and hydro aromatic hydrocarbon, having at least 3 rings wherein the substituent groups are generally hydrocarbons, groups preferably alkyl groups, with it being understood that such polynuclear aromatic and hydro aromatic hydrocarbons can be employed along or in admixture with each other; heterocyclic amines, containing one or more rings, such as pyridines, lutidines, picolines, quinoline, isoquinoline, etc.; phenols, containing one or more rings, such as cresols, xylenols, naphthols; heterocyclic oxygen compounds, such as furfural; and the like. The diluent can be indigenous to the coal liquefaction process; e.g., one of the fractions recovered from the coal liquefaction process which contains polynuclear aromatic and hydro aromatic compounds, or may be provided from an external source.

The diluent is added to the coal liquefaction product having quinoline insolubles (as measured by ASTM test No. D 2318-66) of at least 15 wt%, generally from 15 to 25 wt%, and is added in an amount to provide a mixture having a quinoline insoluble content of no greater than 13 wt%, generally no greater than 10 wt%. It is to be understood that the lower limit of quinoline insolubles is determined by economic considerations in that excess dilution increases costs without a corresponding increase in product recovery. Thus, in general, the quinoline insolubles is not reduced to below 5 wt%; however, lower quinoline insolubles could be employed without an adverse effect. The diluent does not act as a solvent for quinoline insolubles and, therefore, reduces the quinoline insolubles of the mixture by a dilution effect. The diluent, however, is one which functions as a solvent for benzene insoluble components, even though such components have been previously dissolved in the coal liquefaction solvent. Thus, although the diluent, upon addition to the coal liquiefaction product, may not dissolve the quinoline soluble benzene insoluble components in that such components are already dissolved in the coal liquefaction product, such a diluent is capable of dissolving such quinoline soluble benzene insoluble components. As should be apparent, the exact amount of diluent added to the coal liquefaction product is dependent upon the quinoline insoluble content thereof. In general, the diluent is added to the coal liquefaction product in an amount from about 25 to about 100 wt%, preferably from about 35 to about 75 wt%. The selection of the appropriate amount of a particular diluent to provide a diluted product having quinoline insolubles which optimizes recovery of heavier components is deemed to be within the scope of those skilled in the art from the teachings herein.

Subsequent to dilution of the coal liquefaction product, as hereinabove described, the coal liquefaction product, including the diluent, is admixed with a promoter liquid having the properties described in U.S. Pat. No. 3,856,675. As described in the aforementioned patent, the promoter liquid is one that has an aromaticity less than that of the liquefaction solvent and is generally a hydrocarbon liquid having a characterization factor (K) of at least about 9.75 and preferably at least about 11.0, with such characterization factor being an index of the aromaticity/parafinicity of hydrocarbons and petroleum fractions as disclosed by Watson and Nelson, Ind. Eng. Chem. 25 880 (1933). The liquid which is used to enhance and promote the separation of insoluble material is further characterized by a 5 volume percent distillation temperature of at least about 250° F and a 95 volume percent distillation temperature of at least about 350° F and no greater than about 750° F. The promoter liquid preferably has a 5 volume percent distillation temperature of at least about 310° F and most preferably of at least about 400° F. The 95 volume percent distillation temperature is preferably no greater than about 600° F. The most preferred promoter liquid has a 5 volume percent distillation temperature of at least about 425° F and a 95 volume percent distillation temperature of no greater than about 500° F.

As representative examples of such liquids, there may be mentioned: kerosene or kerosene fraction from paraffinic or mixed base crude oils; middle distillates, light gas oils and gas oil fractions from paraffinic or mixed base crude oils; alkyl benzenes with side chains containing 10 or more carbon atoms; paraffinic hydrocarbons containing more than 12 carbon atoms; white oils or white oil fraction derived from crude oils; alpha-olefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes.

The amount of liquid promoter used for enhancing and promoting the separation of insoluble matter from the coal liquefaction product will vary with the particular liquid employed, the coal liquefaction solvent, the coal used as starting material and the manner in which the liquefaction is effected. As should be apparent to those skilled in the art, the amount of liquid promoter used should be minimized in order to reduce the overall costs of the process. It has been found that by using the liquid of controlled aromaticity, in accordance with the teachings of the present invention, the desired separation of insoluble material may be effected with modest amounts of liquid promoter. In general, the weight ratio of liquid promoter, to diluted coal solution may range from about 0.2:1 to about 3.0:1, preferably from about 0.3:1 to about 1.5:1. In using the preferred promoter liquid of the present invention which is a kerosene fraction having 5 percent and 95 percent volume distillation temperatures of 425° F and 500° F respectively, promoter liquid to diluted coal solution weight ratios in the order of 0.4:1 to 0.6:1 have been particularly successful. It is to be understood, however, that greater amounts of liquid promoter may be employed, but the use of such greater amounts is uneconomical. In addition, the use of an excess of liquid promoter may result in the precipitation or separation of an excessive amount of desired coal derived products from the coal extract. More particularly, as the amount of liquid promoter employed is increased, a greater amount of ash is separated from the coal solution, but such an increased separation is accompanied by an increased separation of desired coal derived products from the coal solution.

The separation of the insoluble material from the coal liquefaction product is generally effected at temperatures from about 300° to about 600° F, preferably from about 350° to about 500° F, and a pressure from about 0 psig to about 500 psig, preferably at a pressure from about 0 psig to about 300 psig. It is to be understood however that higher pressures could be employed, but as should be apparent to those skilled in the art, lower pressures are preferred. The insoluble material is generally separated by a gravity settling technique with the essentially insoluble material free coal extract being recovered as an overflow, and the insoluble material as an underflow. The amount of underflow withdrawn from the gravity settling is controlled in order to provide the desired separation of insoluble material. In general, the underflow is withdrawn at a rate of from about 20–25 weight percent of the totalfeed to the gravity settling zone, with the residence time of such settling generally being in the order of from about 0.5 to about 6 hours.

By proceeding in accordance with the present invention and diluting the coal liquefaction product with a liquid which is a solvent for the quinoline soluble benzene insoluble components of the coal liquefaction product, prior to addition of the promoter liquid, there is obtained improved recovery of the 800° F+ components of the coal liquefaction product. In addition, the net coal product (the extracted carbonaceous matter, excluding promoter liquid, diluent, liquefaction solvent and gas make) contains less than about 1% insoluble material, generally less than 0.1% insoluble material, and most preferably less than 0.05% insoluble material, all by weight.

The invention will be further described with respect to an embodiment thereof illustrated in the accompanying drawing. It is to be understood, however, that the scope of the invention is not to be limited thereby.

Referring to the drawing, ground or pulverized coal, generally bituminous, sub-bituminous or lignite, preferably bituminous coal, in line 10 is introduced into a coal solvation and slurrying zone 11 along with a coal liquefaction solvent in line 12. The coal liquefaction solvent may be any one of the wide variety of coal liquefaction solvents used in the art, including both hydrogen donor solvents, non-hydrogen donor solvents and mixtures thereof. These solvents are well known in the art and, accordingly, no detailed description thereof is deemed necessary for a full understanding of the invention. As particularly described, the coal liquefaction solvent is a 600°–900° F solvent which is recovered from the coal liquefaction product and which has not been subjected to hydrogenation subsequent to the recovery thereof. The solvent is added to the coal in an amount sufficient to effect the desired liquefaction, and in general, is added in an amount to provide a solvent to coal weight ratio from about 1:1 to about 20:1, and preferably from about 1.5:1 to about 5:1.

A coal paste is withdrawn from zone 11 through line 13 and introduced into a coal liquefaction zone 14 wherein, as known in the art, the coal is converted to liquid products. The liquefaction zone 14 is operated as known in the art and may be catalytic or non-catalytic and may be effected in the presence or absence of added hydrogen. The hydrogenation may be effected in a fixed catalyst bed, fluidized catalyst bed or in an expanded or ebullating bed. The details of the coal liquefaction step form no part of the present invention and, accodingly, no details thereof are required for a full understanding of the invention. As particularly described, the coal liquefaction is effected in the presence of added hydrogen. The hydrogenation, as known in the art, increases the recovery of coal products and also reduces the sulfur and nitrogen content of the recovered liquid coal product. The liquefaction is preferably effected in an upflow ebullated bed, as known in the art; e.g., as described in U.S. Pat. No. 2,987,465 to Johanson. The coal liquefaction zone, as known in the art, includes means for recovering the various gaseous products.

A coal liquefaction product, comprised of a liquid coal extract of dissolved carbonaceous matter in the coal liquefaction solvent and insoluble material (ash and undissolved coal) is withdrawn from the liquefaction zone 14 through line 15 and introduced into a separation zone 16 to separate from the coal liquefaction product at least those materials boiling up to about the 95 volume percent temperature distillation of the liquid to be used for promoting and enhancing the separation of the insoluble material. The separation zone 16 may include an atmospheric or vacuum flashing chamber or tower, and as particularly described separation zone 16 is designed and operated to separate components boiling up to about 600° F.

A coal liquefaction product, free of components boiling up to about 600° F and having quinoline insolubles of at least 15 wt %, in line 17, is diluted with a liquid, in line 41, which is a solvent for the quinoline soluble and benzene insoluble components of the coal, with the diluent being added in an amount to provide a dilute coal liquefaction product having a quinoline insoluble content of no greater than 13 wt%. The diluent as particularly shown is recovered from the coal liquefaction product and is identical to the coal liquefaction solvent. It is to be understood, however, that other diluents, as hereinabove described, could also be employed within the scope of the present invention.

The diluted coal liquefaction product in line 42 is mixed with promoter liquid in line 21 of controlled aromaticity; i.e., the characterization factor of the promoter liquid has a value which is generally at least 0.25 unit greater than the characterization factor of the coal liquefaction solvent. As particularly described, the promoter liquid is a kerosenefraction which has 5 volume percent and 95 volume percent distillation temperatures which fall within the range from about 425°–500° F and is derived from a naphthenic or paraffinic distillate.

The combined stream of diluted coal liquefaction product and promoter liquid in line 22 is introduced into a gravity separation zone 23, comprised of one or more gravity settlers which may be any one of those known in the art, wherein an essentially solids free overflow is separated from a solid containing underflow.

The overflow essentially free of insoluble material, is withdrawn from separation zone 23 through line 24 and introduced into a recovery zone 25 for recovering promoter liquid and various fractions of the coal extract. The recovery zone 25 may be comprised of one or more fractionators to distill various fractions from the product. As particularly described, the recovery zone is operated to recover a first fraction having 5 percent and 95 percent volume distillation temperatures of from 425° to 500° F which is to be used as the promoter liquid for enhancing and promoting separation of solid material from the coal liquefaction product; a second fraction (600°–900° F) portions of which may be used as the coal liquefaction solvent in line 12 and the diluent in line 41 and a further portion thereof recovered as product; and a residual product (+900° F) of low ash and reduced sulfur content which may be used as a fuel or subjected to further treatment. The promoter liquid recovered in the recovery zone is admixed with the liquefaction product in line 17 and makeup may be provided through line 26.

The underflow containing dispersed insoluble material withdrawn from separation zone 23 through line 31 is introduced into a stripping zone 32 wherein material boiling, below about 900° F is stripped therefrom and introduced into the recovery zone 25 through line 33. The ash rich stripper bottoms in line 34 may then be subjected to calcination or coking. Alternatively, part of the stripper bottoms may be used as feedstock to a partial oxidation process for producing hydrogen. As a further alternative, a portion of the stripper bottoms may be used as plant fuel.

It is to be understood that the present invention is not to be limited to the hereinabove described embodiment in that numerous modifications thereof are possible within the scope of the present invention. Thus, the various processing steps may be effected otherwise than as particularly described, provided that the coal liquefaction product, having quinoline insolubles of at least 15 wt% is diluted with the appropriate solvent, as hereinabove described, to provide a coal liquefaction product having quinoline insolubles of no greater than 13 wt%, prior to admixing the coal liquefaction product with the promoter liquid for effecting separation of the insoluble material by gravity settling.

The invention will be further described with respect to the following examples; however, the scope of the present invention is not to be limited thereby.

EXAMPLES

A coal liquefaction product or deashing feedstock derived from the catalytic hydroliquefaction of Illinois No. 6 caol, whose analytical inspection data is compiled below in Table 1,was used exclusively in all three examples.

TABLE 1

| Deashing Feedstock Analytical Data Compilation | |
|---|---|
| Specific Gravity 60/60° F | 1.302 |
| Softening Point, ° F | 249 |
| Benzene Insolubles, Wt. % | 44.2 |
| Quinoline Insolubles, Wt. % | 17.0 |
| Ash Content, Wt. % | 12.1 |
| Carbon Content, Wt. % | 76.48 |
| Hydrogen Content, Wt. % | 5.72 |
| Nitrogen Content, Wt. % | 1.25 |
| Sulfur Content, Wt. % | 1.72 |
| Vacuum Distillation Data Volume % Distilled | Overhead Vapor Temp. In ° F Corrected to 760 mm Hg. Absolute Pressure |
| 0.0 (IBP) | 400 |
| 5.0 | 547 |
| 10.0 | 593 |
| 15.0 | 623 |
| 20.0 | 657 |
| 25.0 | 704 |
| 30.0 | 750 |
| 35.0 | 800 |
| +800° F Residue | 72.4 wt. % |

EXAMPLE 1

This example does not include dilution of the feedstock to reduce quinoline insolubles.

One Thousand gms of feedstock were charged as a granular solid to a 2.3 liter electrically heated, stainless steel shaker bomb. This apparatus is outfitted with a multiplicity of side drawoff nozzles and a bottom drawoff nozzle, which are all either traced with high pressure steam or asbestos covered electrically heated resistance wire. The contents of the shaker bomb were heated to 530° F with shaking. Five hundred grams of a heavy naphtha (310°–390° F boiling range) promoter liquid was quickly added to the shaker bomb from a pressurized 1 liter addition bomb through a valved line which is attached to the shaker bomb. The contents of the deashing bomb were heated to 530° F and heat soaked at 530° F with shaking for about 15 minutes. Admixture contained in the deashing bomb was allowed to settle without shaking for about 2 hours at 530° F.

An ash lean overflow product was withdrawn through the appropriateside drawoff nozzle and collected in a cooled tared 3 liter necked distillation flask outfitted with a water cooled reflux condenser. An ash enriched underflow was then discharged through the bottom valve into a cooled tared container outfitted with a water cooled reflux condenser. The weights of the overflow and underflow products collected in accordance with the above procedure were found to be 867 gms and 613 gms respectively.

Overflow product was then vacuum distilled at 20 mm Hg absolute pressure to an overhead cut point of 800° F corrected to 760 mm Hg absolute pressure. Vacuum bottoms derived from the above distillation weighed 258 gms and had an ash content of 0.12 wt. %. Forty-six point six percent (46.6 wt. %) of the quinoline soluble +800° F heavy coal product in the feedstock was recovered with the overflow product and an ash removed of 99.7% was observed in this run.

The following Examples 2 and 3 are effected in accordance with the invention.

EXAMPLE 2

Five hundred 525 gms of pyridine and 700 gms of feedstock were charged to the 2.3 liter deashing bomb used in Example 1 and the diluted product has quinoline insolubles of 9.5 wt. %. The contents of the deashing bomb were heated with shaking to 420° F. Four hundred ninety gms of heavy naphtha promoter liquid (same as used in Example 1) were quickly added to the deashing bomb from a pressurized 1 liter addition bomb. The contents of the deashing bomb were then heated to 420° F and heat soaked at 420° F for 30 minutes with shaking. Admixture contained in the deashing bomb was then allowed to settle undistrubed at 420° F for 2 hours.

At the end of the settling period an ash lean overflow was withdrawn through an appropriate sidedraw off nozzle and collected in a tared 3 liter-3 necked distillation flask outfitted with a water cooled condenser. An ash rich underflow product was then discharged through the bottom nozzle and collected in a tared container outfitted with a reflux condenser. The weight of overflow and underflow product collected were 1100 gms and 602 gms respectively.

Overflow product was then vacuum distilled at 20 mm Hg. absolute pressure to an overhead cut point of 800° F corrected to 760 mm Hg. absolute pressure. Vacuum bottoms derived from the above distillation weighed 274 gms and had an ash content of 0.14 wt. %. Thus, 70.7 wt.% of the quinoline soluble +800° F heavy coal product in the feedstock was recovered as an overflow product and an ash removal of 99.5% was realized.

EXAMPLE 3

Twelve kilograms of feedstock are charged as a granular solid to a 25 liter-three necked distillation flask. The contents of the flask are then vacuum distilled at 20 mm Hg. absolute pressure to a nominal 800° F overhead cut point corrected to 760 mm Hg. absolute pressure. Overhead product collected in this distillation is labeled for reference purposes indigenous 400°-800° F boiling range heavy vacuum distillate.

Four hundred gms of the indigenous 400°-800° F boiling range heavy vacuum distillate prepared above are charged to the 2.3 liter deashing shaker bomb used in Examples 1 and 2. Seven hundred gms of feedstock are then charged as a granular solid and the admixture is heated with shaking to 530° F and heat soaked at 530° F for 30 minutes to ensure substantially complete dissolution of the feedstock and provide a diluted feedstock having 10.8 wt.% quinoline insolubles. Four hundred ninety five gms of a heavy naphtha promoter liquid used in Examples 1 and 2 are added via a pressurized 1 liter addition bomb. The admixture in the deashing bomb is heated to 530° F with shaking and then heat soaked at 530° F for 15 minutes with shaking. The deashing bomb's contents are then allowed to settle without shaking at 530° F for 2 hours.

As ash lean overflow stream and ash enriched underflow stream are then withdrawn from the dashing bomb in accordance with the technique used in Examples 1 and 2. An overflow stream weighing 925 gms and an underflow stream weighing 645 gms are obtained. The overflow stream is then vacuum distilled at 20 mm Hg. absolute pressure to a nominal overhead cut point of 800° F corrected to 760 mm Hg. absolute pressure. A vacuum residue wt. of 250 gms and vacuum residue ash content of 0.11 wt.% are observed. These data correspond to a 64.5% recovery of quinoline soluble +800° F heavy coal product with the overflow stream and a 99.7% degree of ash removal.

The above examples indicate the improved recovery of heavier components which results from reduction of quinoline insolubles prior to separation of solids in the presence of a promoter liquid.

The present invention is an improvement over the previous procedure for effecting separation of insoluble material from a coal liquefaction product by the use of a promoter liquid and gravity settling in that by effecting dilution of a coal liquefaction product having quinoline insolubles of at least 15 wt.%, as hereinabove described, prior to admixing the coal liquefaction product with a promoter liquid for effecting separation of the insoluble material by gravity settling, there is obtained improved recovery of the heavier components (800° F+) as an insoluble material free coal extract.

Numerous modifications and variations of the present invention are possible in light of the above teachings and, therefore within the scope of the appended claims, the invention may be practiced otherwise than as particularly described.

What is claimed is:

1. A process for separating insoluble material from a coal liquefaction product produced from a coal feed and comprised of insoluble material and carbonaceous matter dissolved in a coal liquefaction solvent, said coal liquefaction product having quinoline insolubles of at least 15 wt. %, comprising:

diluting said coal liquefaction product with a liquid diluent, said liquid diluent being a solvent for the quinoline soluble and benzene insoluble components in said coal liquefaction product and a nonsolvent for quinoline insoluble components and being added in an amount to provide a mixture of coal liquefaction product and diluent having quinoline insolubles of no greater than 13 wt.%;

mixing the diluted coal liquefaction product with a liquid promoter, said liquid promoter being different from said diluent and having a 5 volume percent distillation temperature of at least about 250° F and a 95 volume percent distillation temperature of at least about 350° F and no greater than about 750° F, said promoter liquid having a characterization factor (K) of at least 9.75, said liquid promoter having a characterization factor greater than said coal liquefaction solvent; and separating insoluble material from said diluted coal liquefaction product mixed with liquid promoter by gravity settling to thereby recover a liquid overflow essentially free of insoluble material and a liquid underflow containing the insoluble material.

2. The process of claim 1 wherein the mixture of coal liquefaction product and diluent has quinoline insolubles of no greater than 10 wt.%.

3. The process of claim 2 wherein the diluent is heterocyclic nitrogen compound.

4. The process of claim 2 wherein the diluent is selected from the group consisting of polynuclear aromatic and hydroaromatic compounds having at least three rings and mixtures thereof.

5. The process of claim 4 wherein the diluent is derived from the coal product.

6. The process of claim 2 wherein the diluent is a phenol.

* * * * *

UNITED STATES PATENT OFFICE

CERTIFICATE OF CORRECTION

Patent No. 4,040,957 Dated August 9, 1977

Inventor(s) Morgan C. Sze et al.

It is certified that error appears in the above-identified patent and that said Letters Patent are hereby corrected as shown below:

Col. 1, line 62, delete "along" and insert --alone--.
Col. 2, line 24, delete "liquiefaction" and insert --liquefaction--.
Col. 3, line 61, delete "totalfeed" and substitute --total feed--.
Col. 4, line 44, delete "accodingly" and insert --accordingly--.
Col. 5, line 22, delete "kerosenefraction" and insert --kerosene fraction--.
Col. 6, line 16, delete "caol" and insert --coal--;
line 43, after "One Thousand", insert --(1000)--;
line 50, after "Five hundred", insert --(500)--;
line 60, delete "appropriateside" and insert --appropriate side--;
line 61, after "3 liter", insert -- -3 --.

UNITED STATES PATENT OFFICE

CERTIFICATE OF CORRECTION

Patent No. 4,040,957 Dated August 9, 1977

Inventor(s) Morgan C. Sze et al.

It is certified that error appears in the above-identified patent and that said Letters Patent are hereby corrected as shown below:

Col. 7, line 9, delete "removed" and insert --removal--;
line 14, after "Five hundred", insert --twenty five (--;
line 14, after "(525", insert --)--.
line 19, after "ninety", insert --(490)--;
line 25, delete "undistrubed" and insert --undisturbed--;
line 47, after "Twelve", insert --(12)--;
line 55, after "hundred", insert --(400)--;
line 58, after "hundred", insert --(700)--;
line 64, after "five", insert --(495)--.

Signed and Sealed this

Twenty-eighth Day of March 1978

[SEAL]

Attest:

RUTH C. MASON
Attesting Officer

LUTRELLE F. PARKER
Acting Commissioner of Patents and Trademarks